US005928064A

United States Patent [19]

Miller

[11] Patent Number: 5,928,064

[45] Date of Patent: Jul. 27, 1999

[54] SURFACE POLISHING METHOD AND SYSTEM

[75] Inventor: Paul David Miller, Dallas, Tex.

[73] Assignee: Auto Wax Company, Inc., Dallas, Tex.

[21] Appl. No.: 09/020,666

[22] Filed: Feb. 9, 1998

Related U.S. Application Data

[63] Continuation of application No. 08/551,462, Nov. 1, 1995, Pat. No. 5,716,259.

[51] Int. Cl.[6] ..... B24B 1/00

[52] U.S. Cl. ..... 451/59; 451/526; 451/54; 29/407.01

[58] Field of Search ..... 451/54, 59, 28, 451/526; 29/424, 407.01

[56] References Cited

U.S. PATENT DOCUMENTS

| | | |
|---|---|---|
| 1,966,101 | 7/1934 | Miller . |
| 4,150,955 | 4/1979 | Samuelson . |
| 4,264,337 | 4/1981 | Fenster et al. . |
| 4,421,526 | 12/1983 | Strickman et al. . |
| 4,484,419 | 11/1984 | Freerks . |
| 4,512,859 | 4/1985 | Inoue . |
| 5,003,659 | 4/1991 | Paepke . |
| 5,066,724 | 11/1991 | Reich et al. . |
| 5,125,191 | 6/1992 | Rhoades . |
| 5,152,809 | 10/1992 | Mattesky . |
| 5,203,883 | 4/1993 | Perry . |
| 5,295,333 | 3/1994 | Püschner . |
| 5,389,032 | 2/1995 | Beardsley . |
| 5,442,816 | 8/1995 | Seketa . |
| 5,476,416 | 12/1995 | Kodate . |

FOREIGN PATENT DOCUMENTS

| | | |
|---|---|---|
| 0 196 832 | 10/1986 | European Pat. Off. . |
| 0 628 382 A1 | 12/1994 | European Pat. Off. . |
| 1-97572 | 4/1989 | Japan . |
| 4-11335 | 2/1992 | Japan . |
| 95005920 | 5/1994 | Japan . |
| 1 518 431 | 7/1978 | United Kingdom . |
| 92/00153 | 1/1992 | WIPO . |
| 96/15877 | 5/1996 | WIPO . |

OTHER PUBLICATIONS

Dialog Web patent family search results 1998 (2 sheets) including a one page Abstract of Japanese Patent JP 6093298 A, which is parent to Japanese Patent 95005920 B2.

English translation of Japanese Patent Application 4–11335 (Feb. 28, 1992).

English translation of Japanese Patent Application 1–97572 (Apr. 17, 1989).

Patent Abstracts of Japan, vol. 013, No. 310 (M–850), Jul. 14, 1989 & JP 01 097572 A (Tadao Koyakata), Apr. 17, 1989.

PCT International Search Report for PCT/US 96/17416, dated Mar. 4, 1997.

PCT International Search Report for PCT/US 98/00540, dated Jun. 22, 1998.

Cryovac, "MPD 2055 Film," 2 pages (publication date is unknown but it is at least as early as Oct. 1995).

*Primary Examiner*—Eileen P. Morgan
*Attorney, Agent, or Firm*—Conley, Rose & Tayon, P.C.; Eric B. Meyertons

[57] ABSTRACT

System and method for locating and polishing a stain or protrusion on a surface of a vehicle. The stain or protrusion may be located by placing a plastic film between a portion of a human hand and the surface. The stain or protrusion may then be removed and/or polished by applying a plastic flexible tool to it.

37 Claims, 3 Drawing Sheets

SURFACE POLISHING METHOD AND SYSTEM

This is a Continuation of application Ser. No. 08/551,462 filed Nov. 1, 1995 (now U.S. Pat. No. 5,716,259).

BACKGROUND OF THE INVENTION

1. Field of the Invention

The present invention relates to a method and system for use in removing and/or polishing a stain and/or protrusion from a surface.

2. Brief Description of the Related Art

When rolling stocks (e.g., automobiles) are placed in parking lots near railways and iron works, or in places close to construction sites where a coating operation is conducted, iron powder and paint mist tend to gather on the coated surface of the rolling stocks and adhere thereto to form minute protrusions. Such unfavorable protrusions may be difficult to see with a human eye. Conventionally, such protrusions were removed by polishing the surface using a compound or a sand paper.

When a compound or sand paper is applied to a surface to remove protrusions, not only are the protrusions brought into contact with the abrasive, but the coated surface is brought into contact with the abrasive as well. Thus, scratches or flaws may be formed on the coated surface. As illustrated schematically in FIG. 3(*a*), it can be seen that this conventional method of polishing tends to suffer from poor operability, because the abrasive force tends to be fully exerted on the coated surface as well as the protrusions if and when the abrasive force is fully applied to the protrusions.

With a view toward ameliorating the poor operability of the conventional method, practitioners have previously proposed in JP-B-4-11335 (the term "JP-B-" as referred to herein signifies "an examined published Japanese patent application") and U.S. Pat. No. 5,476,416 a plastic flexible tool including a plastic flexible material having mixed therewith fine abrasive such as silica sand and calcium carbonate. U.S. Pat. No. 5,476,416 matured from U.S. patent application Ser. No. 08/102,972 and is incorporated hereby by reference.

As noted previously, some surface imperfections may be minute and/or "blend" with the surface in certain light. Thus, some stains and/or protrusions may be relatively difficult to see with a human eye. Since a plastic flexible tool tends to be selectively applied by a practitioner, the practitioner may not readily see a surface imperfection when applying the plastic flexible tool. Thus, some surface imperfections may not be treated by the practitioner with the plastic flexible tool. For instance, a practitioner may apply the plastic flexible tool to an automobile on a cloudy day and not treat surface imperfections which are more visible on a sunny day. Costly and/or tedious repeat treatments may be necessitated.

SUMMARY OF THE INVENTION

A general object of the present invention is to obtain a relatively smooth and/or clean coated surface by polishing and/or removing a stain or protrusion from the surface. Accordingly, the present invention includes locating a surface or protrusion and then controlling both the polishing force being exerted to the protrusion or stain and the polishing force being applied to the planar surface.

A method of the invention may include:

covering at least a portion of a human hand with a plastic film;

determining the location of a stain or protrusion on the surface of the vehicle by touching the surface with at least a portion of the covered human hand, wherein plastic film is between the portion of the human hand and the surface while the surface is being touched;

applying a plastic flexible tool to the stain or protrusion, the plastic flexible tool including a plastic flexible material having an abrasive mixed therewith; and applying a force to the plastic flexible tool such that a polishing force is applied by the plastic flexible tool to the stain or protrusion on the surface.

One system of the invention may include:

a plastic film sized and adapted to cover at least a portion of a human hand, the plastic film having a thickness of between 0.1 mm and 0.75 mm; and a plastic flexible tool including a plastic flexible material having an abrasive mixed therewith.

The abrasive may include grains from about 3 to 50 $\mu$m in diameter.

The ability of the human hand to feel a stain or protrusion on the surface is enhanced by the plastic film. If properly made and applied, the plastic film tends to exaggerate and accent the feel of such protrusions.

The surface may be a surface of a vehicle. The vehicle may be an automobile, motorcycle, boat, truck, plane, or train. The surface may be coated or painted.

The plastic film is preferably substantially transparent. In this manner the practitioner can see the area in which poorly visible protrusions are located by feel. The plastic film may include a polyolefin, polystyrene, parafilm, and polyethylene. The plastic film may include elastomer material and/or an acrylic or methacrylytic material.

The plastic film is preferably not too thin or too thick. If the film is too thin, then its strength and durability may be reduced. If the film is too thick, then the sense of touch is reduced. Preferably the plastic film is less than about 1.0 mm thick, more preferably between about 0.1 mm and less than about 0.75 mm thick, and more preferably still at a thickness of 0.5 mm. The plastic film is preferably sufficiently thin such that tactile sensitivity of the covered portion of the human hand to a surface protrusion is increased.

The plastic film preferably covers at least a portion of a human finger. The plastic film may be in the following shapes: flat and/or substantially planar, glove, mitten, envelope, sleeve, bowl, or finger cot.

One method may include checking the amount of removal of the stain or protrusion on the surface of the vehicle after the flexible plastic tool has been applied. The checking may be accomplished by touching at least a portion of a partially and/or totally covered human hand onto the surface, wherein plastic film is between the portion of the human hand and the surface while the surface is being touched.

One method may include pressing the plastic flexible tool against the surface, thereby deforming the plastic flexible tool to form a substantially flat surface on the plastic flexible tool. The plastic flexible tool may preferably be pressed against the surface such that the protrusion substantially embeds itself into the substantially flat surface of the plastic flexible tool. One preferred method includes reciprocating the substantially flat surface of the plastic flexible tool on the surface such that the protrusion protrudes into the plastic flexible tool and is brought into contact with abrasive inside the plastic flexible tool. Preferably the abrasive is substantially buried inside the plastic flexible tool such that the abrasive does not substantially protrude from the substantially flat surface of the plastic flexible tool.

Preferably the surface is not forcefully contacted with abrasive. Preferably the amount of force applied to the surface is about 1/30 to 1/200 (or, more preferably still, 1/80 to 1/100) of the amount of force applied to the protrusion. In one embodiment about 0.5 to 3.0 percent of force applied to the protrusion is substantially simultaneously applied to the surface.

A lubricant and/or water may be added to the surface such that the lubricant and/or water is between the plastic flexible tool and the surface while the plastic flexible tool is being applied to the surface.

Preferably the stain or protrusion is removed from the surface without substantially scratching the surface.

DETAILED DESCRIPTION OF PREFERRED EMBODIMENTS

A method of the invention may include covering at least a portion of a human hand with a plastic film; determining the location of a stain or protrusion on the surface of the vehicle by touching the surface with at least a portion of the covered human hand, wherein plastic film is between the portion of the human hand and the surface while the surface is being touched; applying a plastic flexible tool to the stain or protrusion, the plastic flexible tool comprising a plastic flexible material having an abrasive mixed therewith; and applying a force to the plastic flexible tool such that a polishing force is applied by the plastic flexible tool to the stain or protrusion on the surface.

Figure 1:
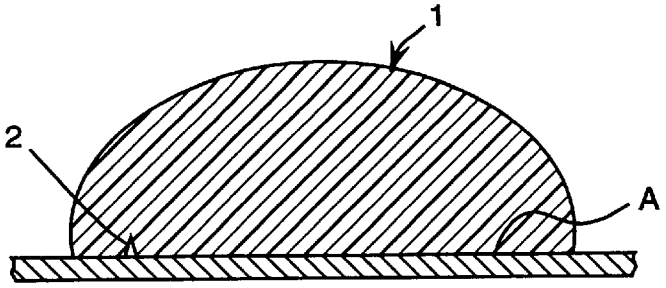
FIG. 1 is an explanatory figure showing a plastic flexible tool in use.
Figure 4:
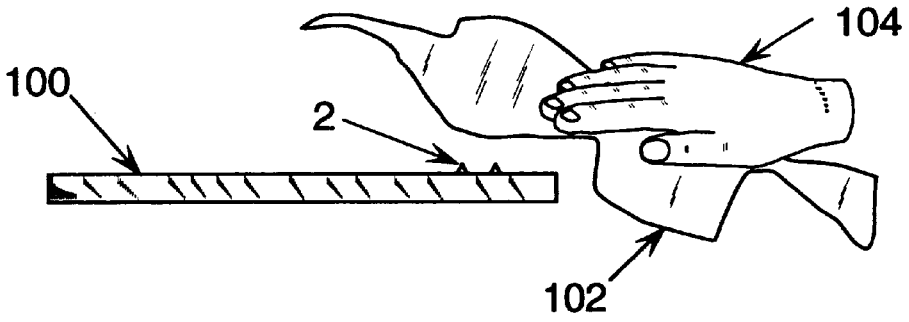
FIG. 4 depicts use of a plastic film.

FIG. 1 depicts a plastic flexible tool 1 applied to a surface with a protrusion 2. FIG. 4 depicts a surface 100 with a protrusion 2. In. FIG. 4 a portion of the human hand 104 is covered by the plastic film 102 such that the plastic film 102 is between the human hand 104 and the surface 100.

Figure 5:
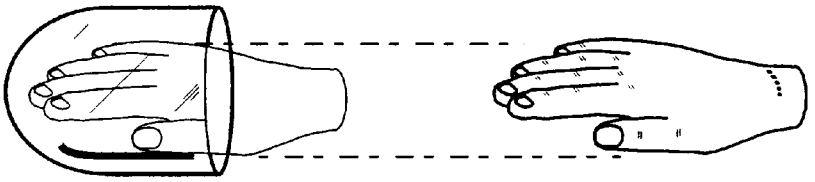
FIGS. 5–8 depict various embodiments of a plastic film.
Figure 6:
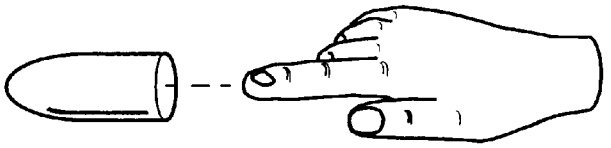
Figure 7:
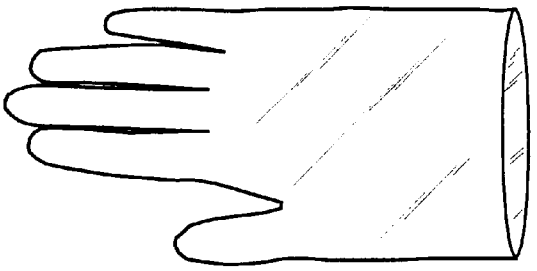
Figure 8:
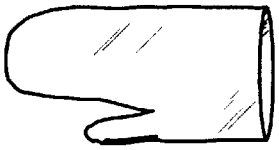

The plastic film preferably covers at least a portion of a human finger. In the context, "covers" means that the plastic film is between the surface to be touched and the portion of the human hand touching the surface. The plastic film may be in the following shapes: flat and/or substantially planar (see FIG. 4), glove (see FIG. 7), mitten (see FIG. 8), envelope, sleeve, or bowl (see FIG. 5), or finger cot (see FIG. 6).

Figure 9:
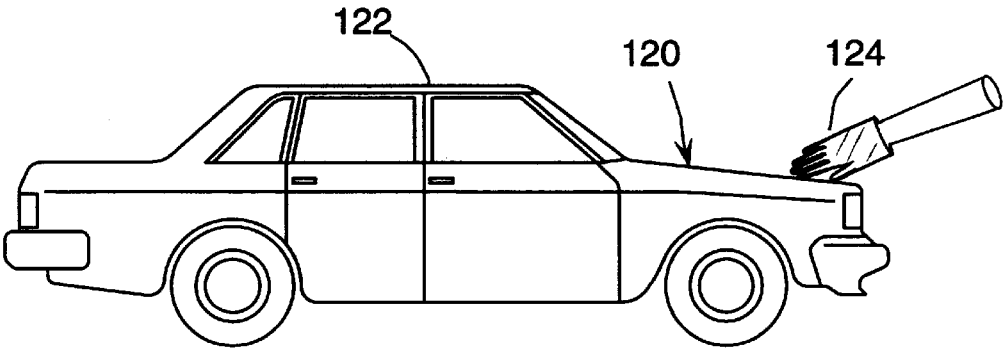
FIG. 9 depicts application of a plastic film onto an exterior surface of an automobile.

The surface may be a surface of a vehicle. The vehicle may be an automobile, motorcycle, boat, truck, plane, or train. The surface may be coated or painted. FIG. 9 depicts an automobile 122 with a surface 120 being touched with a human hand within a glove 124.

The ability of the human hand to feel a stain or protrusion on the surface is enhanced by the plastic film. The plastic film tends to exaggerate and accent the sense of touch when feeling such stains or protrusions. It is believed that the ability of the plastic film to exaggerate and accent the sense of touch is a function of the thickness and modulus of elasticity for the film.

The plastic film is preferably not too thin or too thick. If the film is too thin, then its efficacy, strength and durability may be reduced. If the film is too thick, then the sense of touch is reduced. Preferably the plastic film is less than about 1.0 mm thick, more preferably between about 0.1 mm and less than about 0.75 mm thick, and more preferably still at 0.5 mm thickness. The plastic film is preferably sufficiently thin such that tactile sensitivity of the covered portion of the human hand to a surface protrusion is increased.

The plastic film is also preferably not too elastic or inelastic. Preferably the plastic film has a modulus of elasticity according to ASTM test D-882, Method A, within the range of 50,000 to 120,000 psi at 73° F., and more preferably in the range of 60,000 to 100,000 psi at 73° F.

The plastic film is preferably substantially transparent. In this manner the practitioner can see the area in which poorly visible protrusions are located by feel. The plastic film may include a polyolefin, polystyrene, parafilm, and polyethylene. The plastic film may include elastomer material and/or an acrylic or methacrylytic material.

In one embodiment, Cryovac MPD 2055 50 gauge Shrink Film (available from Innovative Packaging Inc. located in Grand Prairie, Tex., or Cryovac located in Iowa Park, Tex.) was used as the plastic film described above. In addition, Cryovac MPD 2100 50 gauge Shrink Film may also be used. Plastic film mittens that preferably have the following dimensions may be used: 4 and ¼" wide by 3", plus a ¼" lip on the edge of the mittens.

One method may include checking the amount of removal of the stain or protrusion on the surface after the flexible plastic tool has been applied. The checking may be accomplished by touching at least a portion of a covered human hand onto the surface, wherein plastic film is between the portion of the human hand and the surface while the surface is being touched.

One method may include pressing the plastic flexible tool against the surface, thereby deforming the plastic flexible tool to form a substantially flat surface on the plastic flexible tool. The plastic flexible tool may preferably be pressed against the surface such that the protrusion substantially embeds itself into the substantially flat surface of the plastic flexible tool. One preferred method includes reciprocating the substantially flat surface of the plastic flexible tool on the surface such that the protrusion protrudes into the plastic flexible tool and is brought into contact with abrasive inside the plastic flexible tool. Preferably the abrasive is substantially buried inside the plastic flexible tool such that the abrasive does not substantially protrude from the substantially flat surface of the plastic flexible tool.

Preferably the surface is not forcefully contacted with abrasive. Preferably the amount of force applied to the surface is about 1/30 to 1/200 (or, more preferably still, 1/80 to 1/100) of the amount of force applied to the protrusion. In one embodiment about 0.5 to 3.0 percent of force applied to the protrusion is substantially simultaneously applied to the surface.

A lubricant and/or water may be added to the surface such that the lubricant and/or water is between the plastic flexible tool and the surface while the plastic flexible tool is being applied to the surface. The lubricant may include Clay Magic #49 Body Shine (Auto Wax Company, Inc., Dallas, Tex.).

Preferably the stain or protrusion is removed from the surface without substantially scratching the surface.

The plastic flexible tool is preferably made by substantially homogeneously mixing the abrasive with a plastic flexible material.

Figure 10A:
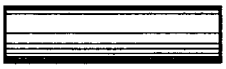
FIGS. 10A–10F depict various shapes of a plastic flexible tool.
Figure 10B:
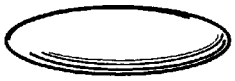
Figure 10C:
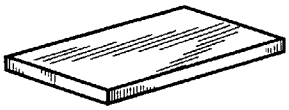
Figure 10D:
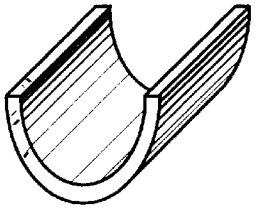
Figure 10E:
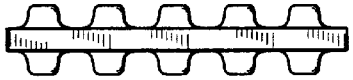
Figure 10F:
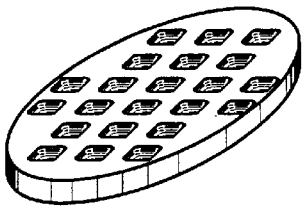

FIGS. 10A–10F depict various shapes in which the plastic flexible tool may be formed. For example, the flexible tool may be in the shape of a bar (FIG. 10A), an oval (FIG. 10B), a flat plane (FIG. 10C), a bent plane (FIG. 10D), a flat plane with raised portions (FIG. 10E), or a "waffle" (FIG. 10F). The plastic flexible tool may become contaminated with dirt during use. Some of the above-referenced shapes tend to maximize the amount of clean surface area available for a certain tool volume.

A plastic flexible tool may be produced by mixing 100 parts by weight of a petroleum resin (e.g., polybutene) as a plastic flexible material with 65 parts by weight of fine silica sand and calcium carbonate grains from 20 to 30 $\mu$m in diameter, and, optionally, 5 parts by weight of a powder synthetic detergent composed of grains 500 $\mu$m in diameter.

Figure 2:
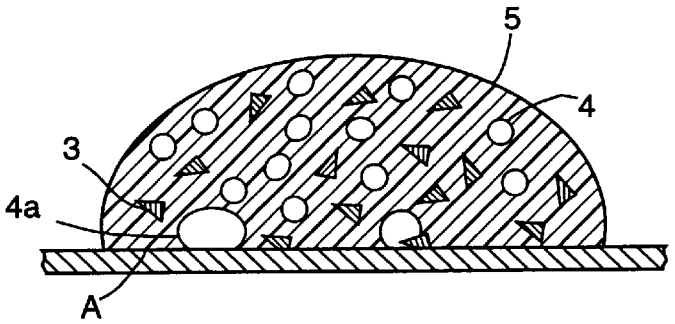
FIG. 2 is a cross sectional view of a plastic flexible tool with the abrasive thereof forming protrusions against the polishing surface.

Referring to FIG. 1, the flexible tool 1 above may be used for removing a small protrusion 2 (e.g., a protrusion 0.5 mm in height and 1 mm in width) from the coated planar surface A. First, the protrusion may be located and/or detected by touching the surface with a portion of a human hand covered with a plastic film. Once the protrusion is located, the flexible tool may be pressed against coated planar surface A to form a flat plane on the flexible tool. Fine abrasive 3 and, optionally, powder synthetic detergent 4 may be distributed within a flexible material 5 as shown in FIG. 2. By reciprocating the planar surface of the flexible tool 1 on the coated planar surface A having the protrusion 2 thereon, the protrusion 2 may be removed completely from the coated planar surface A in a relatively small time period (e.g., about 30 seconds). A stain on the coated planar surface may be removed at the same time. A coated surface as plain and smooth as the surface before polishing may be obtained free from scratches and flaws by the polishing operation.

Referring again to FIG. 2, in one embodiment a pore 4*a* can be seen to open on the surface in contact with the coated planar surface A, due to the dissolution of the powder synthetic detergent 4. The open pore 4*a* tends to facilitate sticking of the fine abrasive against the polishing surface. In this manner, the polishing speed of the planar surface may be accelerated.

Hard fine grains such as alumina, ceramics, and/or Green Carborundum may be incorporated in the flexible material as the fine abrasive 3. These grains may be in addition to or replace the aforementioned grains of silica sand and calcium carbonate. Any of the abovementioned abrasives may be used either alone or as a mixture of two or more selected therefrom. The fine abrasive grains are preferably confined to a diameter in the range of 20 to 30 $\mu$m, but the size may also be within a range of from about 3 to about 50 $\mu$m depending on the object of polishing. The amount of fine abrasive may be varied within a range of from about 60 to 80 parts by weight with respect to 100 parts by weight of plastic flexible material.

In removing small protrusions from the coated surface using the plastic flexible tool according to the present invention the plastic flexible tool is preferably pressed against a flat and hard plane to form a flat surface on the plastic flexible tool. At this stage, the fine abrasive may be buried inside the flat surface of the plastic flexible tool to leave no edges thereof sticking out from the flat surface of the plastic flexible tool.

When the flat surface of the plastic flexible tool is placed over a small protrusion on the coated surface, the small protrusion tends to bore a small hole on the flat surface of the plastic flexible tool and accommodate itself therein. This tendency is illustrated in FIG. 1. When the flexible tool is repeatedly reciprocated on the coated surface along the direction indicated with the arrows shown in FIG. 1, the flat surface of the plastic flexible tool moves with its surface being cut with the small protrusion. Since the fine abrasive is not pressed uniformly by the small protrusion, the edges of the fine abrasive stick out from the flexible material.

Accordingly, the fine abrasive sticking out from the flexible material may be brought forcibly into contact with the small protrusion to conduct polishing. The flat surface formed on the flexible tool is also brought into contact with the coated surface in this case, however, the coated surface suffers little or no scratches or flaws because the edges of the fine abrasive do not stick out from the flat surface of the flexible material.

Figure 3A:
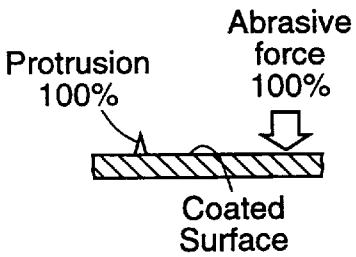
FIG. 3 is a schematic figure provided as an explanatory means to show the exertion of polishing force against the protrusions and stain.
Figure 3B:
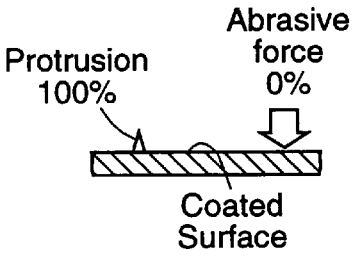
Figure 3C:
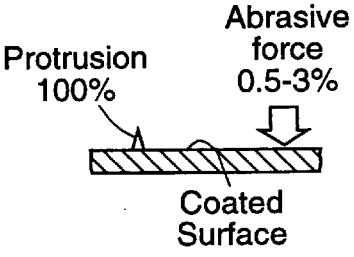

Water may be sprayed to the region on which the flexible tool is moved or to the flexible tool. The powder detergent, if any, incorporated into the flexible tool may then dissolve into the water to allow the fine abrasive to be exposed on the surface. The amount of the exposed fine abrasive can be controlled by the amount of powder detergent being incorporated into the flexible tool. The fine abrasive grains sticking out from the polishing surface immediately slip into the flexible material upon detection of a resistance on the polishing surface. In this manner, the polishing force against the flat surface may be about 1/80 to 1/100 of the force applied to a protrusion. Force is thus applied to both the protrusion and the surface stain when polishing is conducted as shown in FIG. 3(*c*). Specifically, about 0.5 to 3% of a polishing force may be applied to the stain with respect to 100% of the force applied to the protrusion.

The polishing ability against a flat surface may be controlled in the range of from 1/30 to 1/200 of the force applied to a protrusion.

In removing both the protrusion and the stain from a coated surface, it is preferred that the protrusion and the stain are removed within a same duration of time, or the protrusion is removed faster than the stain. It is not desirable to have the stain be removed faster than the protrusion, because the polishing marks of the protrusion may remain on the coated surface.

The plastic flexible tool according to the present invention may include a flexible material having mixed therewith fine abrasive and powder synthetic detergent. Accordingly, the flexible tool according to the present invention is capable of removing small protrusions and stains from the surface without impairing a flat or curved plane of a coated surface. This removal is accomplished by maintaining a uniform surface against the area to be polished. Furthermore, the plastic flexible tool tends to facilitate rapid operation because it can be worked with a small frictional force. A plastic flexible tool may be available from Auto Wax Company, Inc. (Dallas, Tex.), Joybond Co., Inc. (Tokyo, Japan), Auto Chemie Co., Ltd. (Tokyo, Japan), Honda Motor Co. (Tokyo, Japan) or Nissan Motor Co. (Tokyo, Japan). Auto Wax Company, Inc. sells a plastic flexible tool under the "Clay Magic®" tradename.

While the invention has been described in detail and with reference to specific embodiments thereof, it will be apparent to one skilled in the art that various changes and modifications can be made therein without departing from the spirit and scope thereof.

What is claimed is:

1. A method of polishing a stain or protrusion from a surface, comprising:

covering at least a portion of a human hand with a plastic film;

determining the location of a stain or protrusion on the surface by touching the surface with at least a portion of the covered human hand, wherein plastic film is between the portion of the human hand and the surface while the surface is being touched;

applying a plastic flexible tool to the stain or protrusion, the plastic flexible tool comprising a plastic flexible material having an abrasive mixed therewith; and applying a force to the plastic flexible tool such that a polishing force is applied by the plastic flexible tool to the stain or protrusion on the surface.

2. The method of claim 1 wherein the abrasive comprises grains from about 3 to 50 $\mu$m in diameter.

3. The method of claim 1 wherein the ability of the human hand to feel a stain or protrusion on the surface is enhanced by the plastic film.

4. The method of claim 1 wherein the surface is a painted exterior of the automobile.

5. The method of claim 1 wherein the plastic film is substantially transparent.

6. The method of claim 1 wherein the plastic film comprises a polyolefin.

7. The method of claim 1 wherein the plastic film is between about 0.1 mm to 0.75 mm thick.

8. The method of claim 1 wherein the plastic film is less than about 1.0 mm thick.

9. The method of claim 1, further comprising checking the amount of removal of the stain or protrusion on the surface after the flexible plastic tool has been applied, the checking being accomplished by touching at least a portion of the covered human hand onto the surface, wherein plastic film is between the portion of the human hand and the surface while the surface is being touched.

10. The method of claim 1, further comprising pressing the plastic flexible tool against the surface, thereby deforming the plastic flexible tool to form a substantially flat surface on the plastic flexible tool.

11. The method of claim 1 wherein the plastic film covers at least a portion of a human finger.

12. The method of claim 1, further comprising pressing the plastic flexible tool against the surface, thereby deforming the plastic flexible tool to form a substantially flat surface on the plastic flexible tool, and wherein the tool is pressed against the surface such that the protrusion substantially embeds itself into the substantially flat surface of the tool.

13. The method of claim 1 wherein the plastic flexible tool is pressed against the surface such that the protrusion substantially embeds itself into the substantially flat surface of the plastic flexible tool, and further comprising reciprocating the substantially flat surface of the plastic flexible tool on the surface such that the protrusion protrudes into the plastic flexible tool and is brought into contact with abrasive inside the plastic flexible tool.

14. The method of claim 1, further comprising reciprocating the substantially flat surface of the plastic flexible tool on the surface.

15. The method of claim 1 wherein the abrasive is substantially buried inside the plastic flexible tool such that the abrasive does not substantially protrude from the substantially flat surface of the plastic flexible tool.

16. The method of claim 1 wherein the abrasive is substantially buried inside the plastic flexible tool such that the abrasive does not substantially protrude from the substantially flat surface of the plastic flexible tool, and wherein the plastic flexible tool is pressed against the surface such that a protrusion substantially embeds itself into the substantially flat surface of the plastic flexible tool, and further comprising reciprocating the substantially flat surface of the plastic flexible tool on the surface such that the protrusion protrudes into the plastic flexible tool and is forcefully contacted with abrasive inside the plastic flexible tool.

17. The method of claim 1 wherein the surface is not forcefully contacted with abrasive.

18. The method of claim 1 wherein force is applied to the protrusion and the surface, and wherein the amount of force applied to the surface is about 1/30 to 1/200 of the amount of force applied to the protrusion.

19. The method of claim 1 wherein force is applied to the protrusion and the surface, and wherein the amount of force applied to the surface is about 1/80 to 1/100 of the amount of force applied to the protrusion.

20. The method of claim 1 wherein a force is applied to the protrusion, and wherein about 0.5 to 3.0 percent of such force is substantially simultaneously applied to the surface.

21. The method of claim 1 wherein the plastic film is less than about 1.0 mm thick and has a modulus of elasticity according to ASTM test D-882, Method A, within the range of 50,000 to 120,000 psi at 73° F.

22. The method of claim 1, further comprising adding water to the surface such that the water is between the plastic flexible tool and the surface while the plastic flexible tool is being applied to the surface.

23. The method of claim 1, further comprising shaping the plastic flexible tool to be substantially flat before applying the plastic flexible tool to the surface.

24. The method of claim 1 wherein the plastic film is sufficiently thin such that tactile sensitivity of the covered portion of the human hand to a surface protrusion is increased.

25. The method of claim 1, further comprising removing the stain or protrusion from the surface without substantially scratching the surface.

26. A vehicle having a surface polished by the method of claim 1.

27. An automobile having an exterior painted surface that is polished by the method of claim 1.

28. The method of claim 1 wherein the plastic film comprises an acrylic material.

29. The method of claim 1 wherein the plastic film is a mitten.

30. The method of claim 1, further comprising adding lubricant to the surface such that the lubricant is between the plastic flexible tool and the surface while the plastic flexible tool is being applied to the surface.

31. The method of claim 1 wherein the abrasive and the plastic flexible material are substantially homogeneously mixed together.

32. The method of claim 1 wherein the flexible tool is substantially in the shape of a bar.

33. The method of claim 1 wherein the plastic flexible tool comprises petroleum resin, and sand.

34. The method of claim 1 wherein the plastic flexible tool comprises powder detergent.

35. The method of claim 1 wherein the abrasive comprises a fine abrasive, the amount of fine abrasive being about 60 to about 80 parts by weight with respect to about 100 parts by weight of plastic flexible material.

36. The method of claim 1 wherein the plastic flexible tool comprises petroleum resin, fine silica sand, and calcium carbonate.

37. The method of claim 1 wherein the abrasive comprises alumina.

* * * * *